US005782113A

United States Patent [19]

Chen

[11] Patent Number: 5,782,113

[45] Date of Patent: Jul. 21, 1998

[54] COMBINATION LOCK

[76] Inventor: Cheng Jung Chen, No. 47, Heyming Street, Lugaang Village, Changhua County, Taiwan

[21] Appl. No.: 940,799

[22] Filed: Sep. 30, 1997

[51] Int. Cl.[6] ..... E05B 37/02

[52] U.S. Cl. ..... 70/28; 70/312

[58] Field of Search ..... 70/21–30, 311, 70/321, 322, 324, 315–318, 312

[56] References Cited

U.S. PATENT DOCUMENTS

| | | | |
|---|---|---|---|
| 659,045 | 10/1900 | Arness | 70/312 |
| 835,304 | 11/1906 | Indelli | 70/312 |
| 1,205,781 | 11/1916 | Piróg | 70/312 |
| 1,316,037 | 9/1919 | Hewitt | 70/312 X |
| 4,111,014 | 9/1978 | Epstein | 70/312 X |
| 4,610,152 | 9/1986 | Düringer | 70/30 |
| 4,831,860 | 5/1989 | Sheiman et al. | 70/312 |
| 4,860,561 | 8/1989 | Hwang | 70/28 |
| 5,027,623 | 7/1991 | Ling | 70/26 |
| 5,042,277 | 8/1991 | Jenn-Rong | 70/28 |
| 5,193,367 | 3/1993 | Ling | 70/312 X |
| 5,685,179 | 11/1997 | Yang | 70/28 |

*Primary Examiner*—Lloyd A. Gall

*Attorney, Agent, or Firm*—Pro-Techtor International Services

[57] ABSTRACT

A combination lock is composed of a lock body, a locking mechanism, an unlocking mechanism, and a cover. The locking mechanism is located in a horizontal slot of the lock body such that the arresting rod of the locking mechanism can be directly actuated by the unlocking mechanism, and that one end of a shackle of the lock body is separated from a press portion of the unlocking mechanism by a distance capable of preventing a finger pressing the press portion from obstructing the shackle to be fastened With an object intended to be disabled.

1 Claim, 6 Drawing Sheets

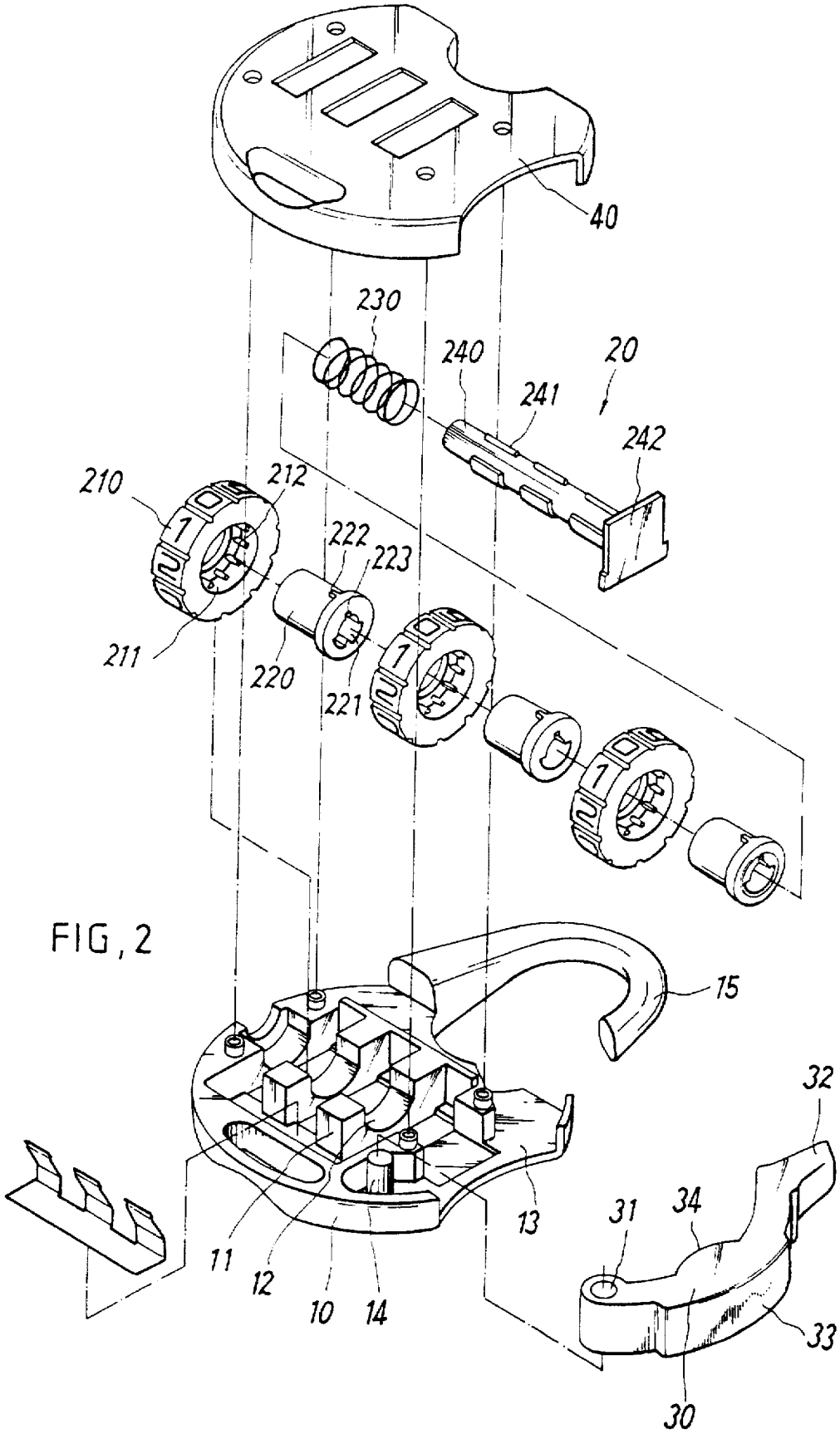
FIG, 2

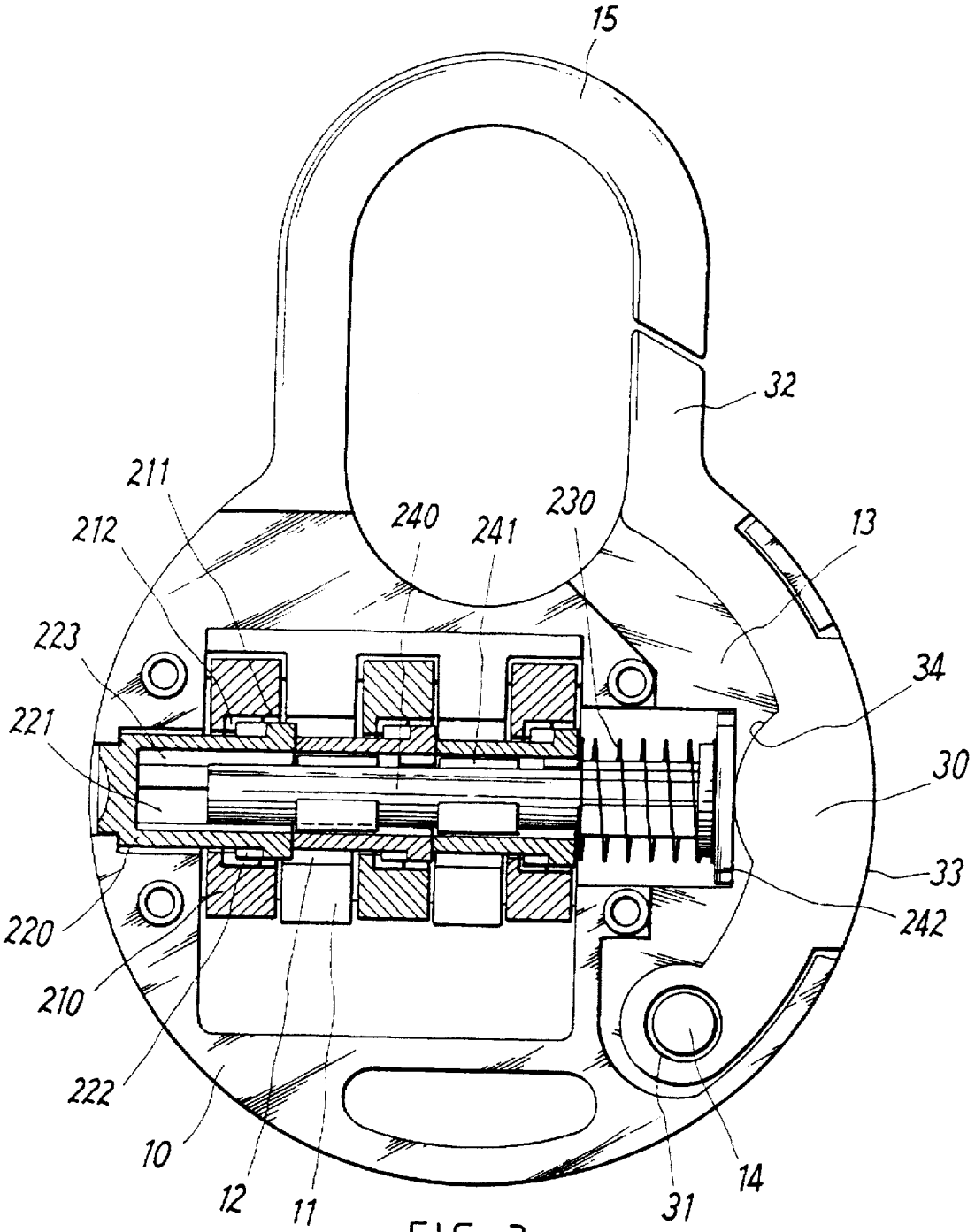
FIG, 3

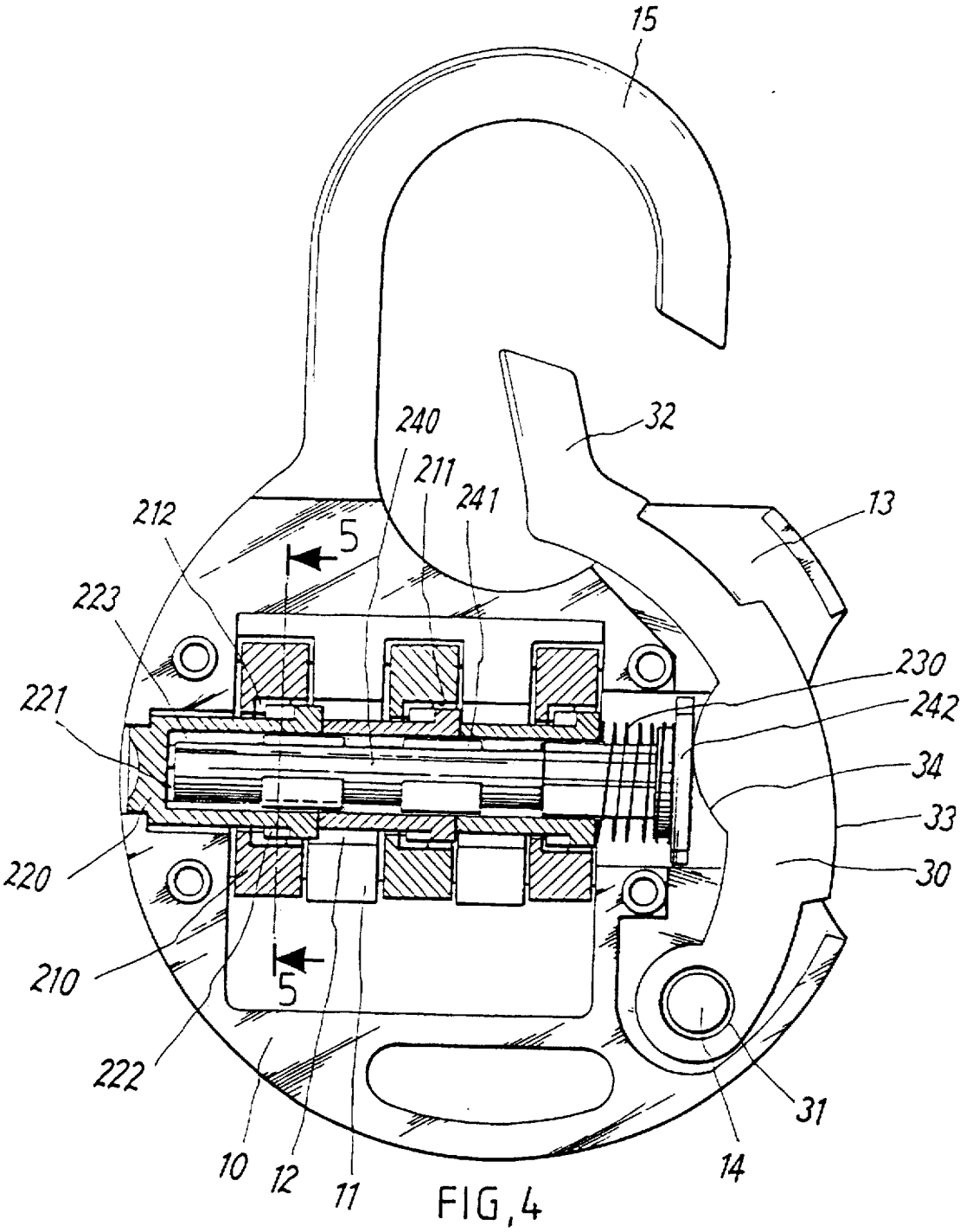
FIG, 4

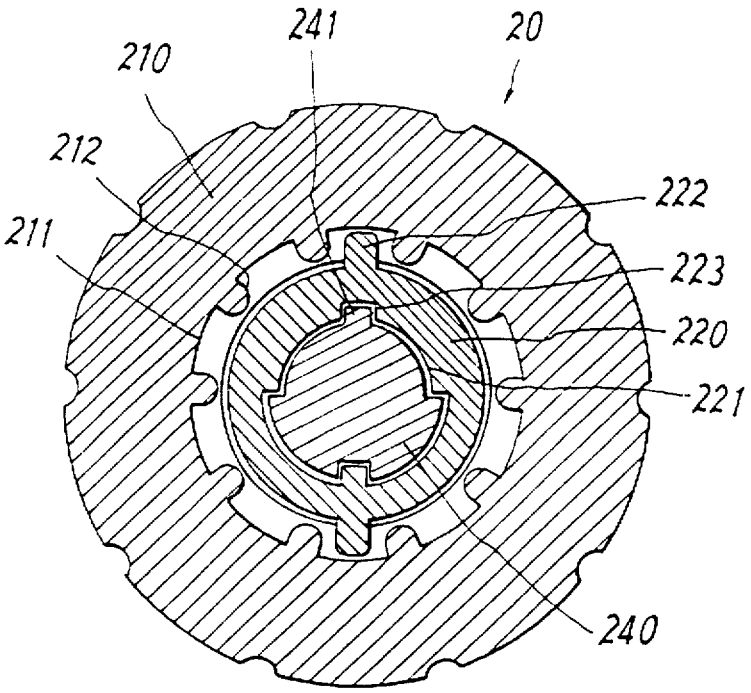
5-5
FIG, 5

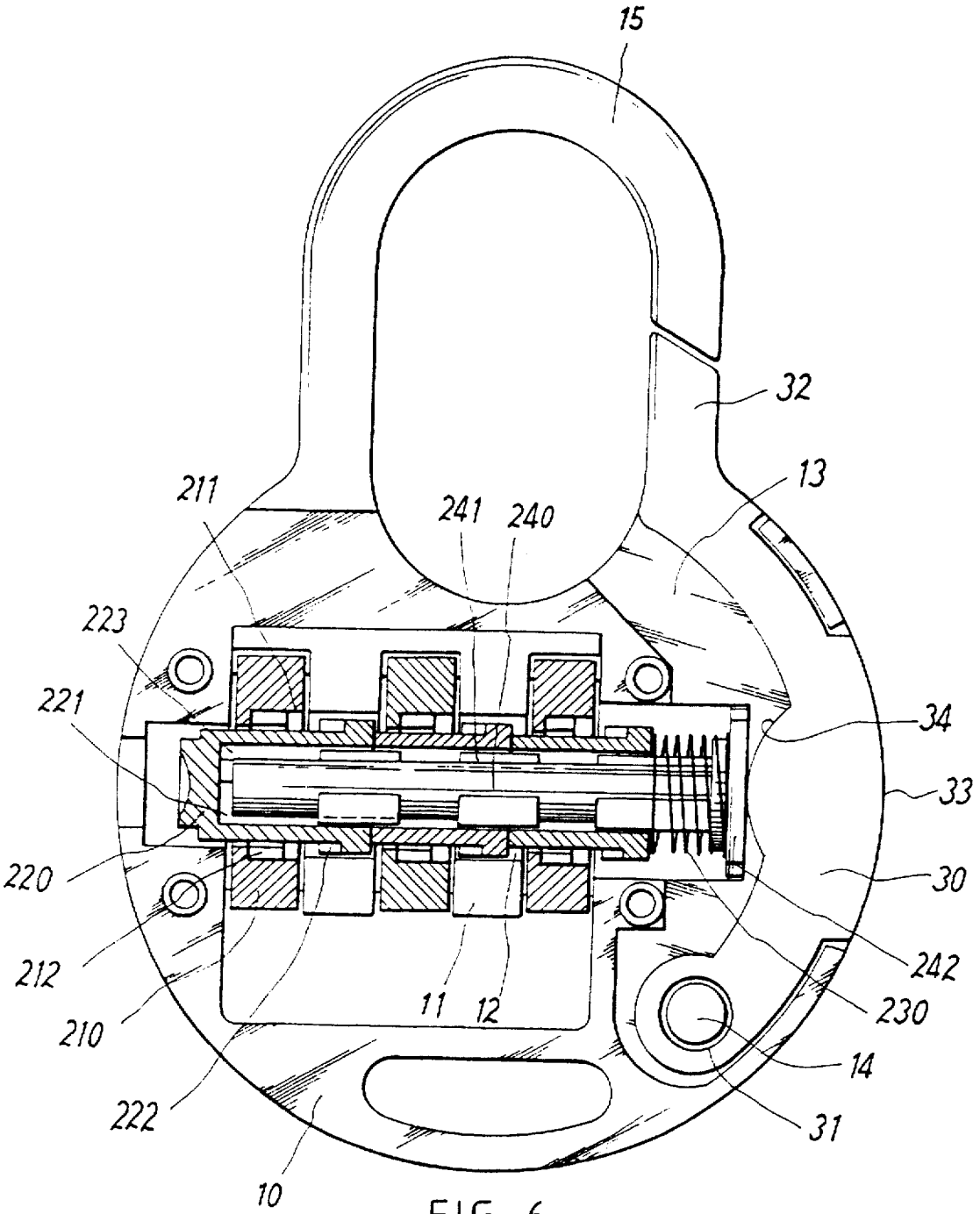
FIG, 6

COMBINATION LOCK

FIELD OF THE INVENTION

The present invention relates generally to a lock, and more particularly to a combination lock which is operated by a dial that is turned to a set series of numbers or letters to work the mechanism so as to open the lock.

BACKGROUND OF THE INVENTION

The conventional combination lock is generally composed of a body, a plurality of numbered wheels, a cylindrical body, a numbering shaft, a spring an urging rod, a movable rod, etc. Such conventional combination lock is defective in design in that it is rather complicated in construction, and that it is therefore not cost-effective.

SUMMARY OF THE INVENTION

The primary objective of the present invention is therefore to provide a combination lock which is relatively simple in construction and is therefore relatively cost-effective.

In keeping with the principle of the present invention, the foregoing objective of the present invention is attained by a combination lock, which is composed of a body, a locking device, and an unlocking device. The locking device is horizontally located in the lock body such that the locking device is easily operated by the unlocking device located at one side of the lock body.

BRIEF DESCRIPTION OF THE DRAWINGS

FIG. 2 shows an exploded view of the combination lock of the embodiment of the present invention.

FIG. 3 shows a sectional schematic view of the present invention in combination.

FIG. 4 shows a schematic view of the present invention at work.

FIG. 5 shows a partial sectional view of the present invention as shown in FIG. 4.

FIG. 6 shows another schematic view of the present invention at work.

DETAILED DESCRIPTION OF THE EMBODIMENT

Figure 1:
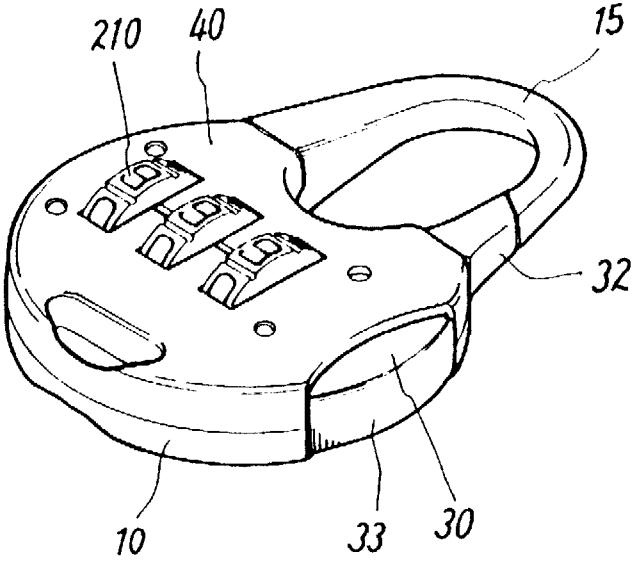
FIG. 1 shows a perspective view of a combination lock of the embodiment of the present invention.

As shown in FIGS. 1 and 2, a combination lock embodied in the present invention is composed of a lock body 10, a locking device 20, an unlocking device 30, and a cover 40. The lock body 10 is provided in the interior thereof with a plurality of protruded plates 11 for forming a horizontal slot 12, which is in turn provided at one side thereof with a key placing area 13. Located at the bottom of the key placing area 13 is a support shaft 14. The lock body 10 is provided with a shackle 15 attached thereto.

The locking device 20 consists of a plurality of rotary wheels 210, arresting blocks 220, a spring 230, and an arresting rod 240. The rotary wheels 210 are provided at the center thereof with a stepped hole 211 which is in turn provided in the inner wall thereof and the radial bottom surface thereof with a plurality of teeth 212 spaced equidistantly. The arresting blocks 220 are cylindrical in shape and provided with a through hole 221. The arresting blocks 220 are further provided in the periphery thereof with a plurality of engaging teeth 222. The through hole 221 is provided in the inner wall thereof with a groove 223. The arresting rod 240 is provided in the outer wall thereof with a plurality of ribs 241 and at one end thereof with a stop plate 242.

The unlocking device 30 is provided at one end thereof with a rotating hole 31, and at another end thereof with a lock rod 32 opposite in location to one end of the shackle 15. Located between the rotating hole 31 and the lock rod 32 are a press portion 33 and an arcuate portion 34 opposite in location to the press portion The cover 40 is engaged with the lock body 10 for shielding those components which are located in the lock body 10.

As shown in FIG. 3, the locking device 20 is fitted into the spring 230, the arresting blocks 220 and the rotary wheels 210 such that the teeth 212 of the rotary wheels 210 are engaged with the engaging teeth 222 of the arresting blocks 220. The locking device 20 is received in the horizontal slot 12 of the lock body 10. The arcuate portion 34 of the unlock device 30 is urged by the stop plate 242.

As illustrated in FIGS. 3, 4 and 5, the unlocking device 30 is operated by turning the rotary wheels 210 such that the teeth 212 of the stepped hole 211 are engaged with the engaging teeth 222, so as to actuate the arresting blocks 220 to turn to cause the grooves 223 to be opposite in location to the ribs 241 of the arresting rod 240. In other words, as the wheels 210 are turned to show a set series of numbers, the press portion 33 can be so pressed as to cause the unlocking device 30 to turn on the support shaft 1.4, thereby causing the arcuate portion 34 to force the stop plate 242 to move. As a result, the arresting rod 240 is caused to move axially. In the meantime, the lock rod 32 is disengaged with one end of the shackle 15. As the press portion 33 is relieved of the pressure exerting thereon, the stop plate 242 is pushed by the spring 230 to force the arcuate portion 34. As a result, the arresting rod 240 and the unlocking device 30 are caused to return to their respective original position. As any one of the rotary wheels 210 is dialed, the ribs 241 and the grooves 223 are no longer corresponding in location to one another. As a result, the arresting rod 240 is no longer capable of axial motion. The unlocking device 30 is thus incapacitated in view of the fact that the arcuate portion 34 of the unlocking device 30 is urged by the stop plate 242.

The locking device 20 is horizontally located in the lock body 10 such that the distance between one end of the shackle 15 and the press portion 33 of the unlocking device 30 is lengthened to provide an added space to facilitate the operating of the combination lock of the present invention with fingers.

As illustrated in FIG. 6, a new set series of numbers can be reset by turning the rotary wheels 210 such that the old set series of numbers are shown. The arresting blocks 220 can be manipulated by a pointed object to move axially on the arresting rod 240. In the meantime, the spring 230 is forced to compress against the stop plate 242. As the arresting blocks 220 are forced to displace axially the engaging teeth 222 become disengaged from the teeth 212 of the rotary wheels 210. The rotary wheels 210 are turned freely until a desired set series of numbers is attained. As the arresting blocks 220 are released, the reaction force of the spring 230 pushes all the arresting blocks 220 back to their respective original position such that the engaging teeth 222 of the arresting blocks 220 are once again engaged with the teeth 212 of the rotary wheels 210.

The embodiment of the present invention described above is to be deemed in all respects as being merely illustrative and not restrictive. Accordingly, the present invention may be embodied in other specific forms without deviating from the spirit thereof. The present invention is therefore to be limited only by the scope of the following appended claim.

What is claimed is:

1. A combination lock comprising:

a lock body provided therein with a horizontal slot;

a lock device comprising a plurality of rotary wheels, arresting blocks, a spring, and an arresting rod, said rotary wheels provided at a center thereof with a stepped hole having a plurality of teeth spaced equidistantly, said arresting blocks provided with a through hole having in an inner wall thereof a plurality of grooves, said arresting blocks further provided in an outer wall thereof with a plurality of engaging teeth, said arresting rod provided in an outer wall thereof with a plurality of ribs and further provided at one end thereof with a stop plate;

an unlocking device provided at one end thereof with a rotating hole and at another end thereof with a lock rod engageable with one end of a shackle attached to said lock body, said rotating hole and said lock rod being located on opposite sides of said arresting rod when said lock rod engages said shackle, said unlocking device further provided with a press portion and an arcuate portion opposite in location to said press portion; and a cover engaged with said lock body;

wherein said lock device is located in said horizontal slot of said lock body such that said arresting rod can be actuated by said unlocking device, and that said one end of said shackle is separated from said press portion of said unlocking device by a distance capable of preventing a finger pressing said press portion from obstructing said shackle to be fastened with an object.

* * * * *